US012773029B2

(12) United States Patent
Ganes

(10) Patent No.: US 12,773,029 B2
(45) Date of Patent: Oct. 27, 2026

(54) CHINSTRAP FOR HELMET

(71) Applicant: Jackal Jaw, LLC, Katonah, NY (US)

(72) Inventor: Matthew S. Ganes, Mt. Kisco, NY (US)

(73) Assignee: Jackal Jaw, LLC, Katonah, NY (US)

( * ) Notice: Subject to any disclaimer, the term of this patent is extended or adjusted under 35 U.S.C. 154(b) by 0 days.

(21) Appl. No.: 18/939,058

(22) Filed: Nov. 6, 2024

(65) Prior Publication Data

US 2025/0151832 A1 May 15, 2025

Related U.S. Application Data

(60) Provisional application No. 63/598,047, filed on Nov. 10, 2023.

(51) Int. Cl.
*A42B 3/08* (2006.01)

(52) U.S. Cl.
CPC ..... *A42B 3/08* (2013.01)

(58) Field of Classification Search
CPC .. A42B 3/08; A42B 3/085; A42B 3/20; A42B 3/205; A42B 3/326
See application file for complete search history.

(56) References Cited

U.S. PATENT DOCUMENTS 3,041,623 A * 7/1962 Glahe ..... A63B 71/10 2/9
3,787,895 A * 1/1974 Belvedere ..... A42B 3/20 2/9
4,021,858 A * 5/1977 Neeld ..... A42B 3/08 2/9
4,335,472 A * 6/1982 Rappleyea ..... A42B 3/08 2/421
5,347,660 A * 9/1994 Zide ..... A42B 3/08 2/421
5,794,274 A * 8/1998 Kraemer ..... A42B 3/08 2/9
6,481,024 B1 * 11/2002 Grant ..... A42B 3/08 2/9
7,886,370 B2 * 2/2011 Winningham ..... A63B 71/10 2/9
7,921,475 B2 * 4/2011 Nascimento ..... A42B 3/08 2/424
8,959,668 B1 * 2/2015 Ganes ..... A42B 3/205 2/9
9,345,281 B1 * 5/2016 Schiebl ..... A42B 3/205
9,681,695 B2 * 6/2017 Beauchamp ..... A42B 3/205
9,756,889 B2 * 9/2017 Infusino ..... A42B 3/08
10,292,447 B2 * 5/2019 Connelly ..... A41D 13/05
10,568,377 B2 * 2/2020 Sicking ..... A42B 3/08
11,388,944 B2 * 7/2022 Connelly ..... A41D 13/0568
11,659,884 B2 * 5/2023 Durocher ..... A42B 3/20 2/424
11,766,084 B2 * 9/2023 Lowe ..... A42B 3/205 2/421
11,992,077 B2 * 5/2024 Reece ..... A42B 3/08
(Continued)

*Primary Examiner* — F Griffin Hall
(74) *Attorney, Agent, or Firm* — POLSINELLI PC

(57) ABSTRACT

A chinstrap for a helmet. The chinstrap includes a chin cup to receive a helmet wearer's chin and a protective structure for supporting the chin cup. The chinstrap also includes an attachment assembly to secure the chin cup to straps used to secure the chinstrap to the helmet.

20 Claims, 5 Drawing Sheets

(56) References Cited

U.S. PATENT DOCUMENTS

| | | | | |
|---|---|---|---|---|
| 2004/0003452 | A1* | 1/2004 | Schiebl | A42B 3/08 2/421 |
| 2013/0111654 | A1* | 5/2013 | Gorsen | A42B 3/205 2/421 |
| 2018/0084858 | A1* | 3/2018 | Schiebl | A42B 3/205 |
| 2021/0112905 | A1* | 4/2021 | Lanphear | A42B 3/205 |

* cited by examiner

CHINSTRAP FOR HELMET

STATEMENT REGARDING FEDERALLY SPONSORED RESEARCH OR DEVELOPMENT

Not applicable.

CROSS-REFERENCE TO RELATED APPLICATIONS

The present application is a conversion of U.S. Provisional Application having U.S. Ser. No. 63/598,047, filed Nov. 10, 2023, which claims the benefit under 35 U.S.C. 119 (e). The disclosure of which is hereby expressly incorporated herein by reference.

BACKGROUND OF THE DISCLOSURE

1. Field of the Invention

The present disclosure relates to a chinstrap for use with a helmet that is more secure and provides more comfort.

2. Description of the Related Art

There are numerous chinstraps that have been developed for use with helmets used in contact sports. The various developed chinstraps have varying benefits and shortcomings. They have various fastening mechanisms used to secure chinstraps to the helmets. They incorporate various padding and structural features. With all of these various types of chinstraps there are deficiencies in how secure they are and the comfort they provide.

Accordingly, there is a need for a chinstrap that can increase how securely the chinstrap is mounted to straps of a helmet and still be extremely comfortable for the wearer.

SUMMARY OF THE DISCLOSURE

The present disclosure is directed to a chinstrap for a helmet. The chinstrap includes a chin cup to receive a helmet wearer's chin and a protective structure for supporting the chin cup. The chinstrap also includes an attachment assembly to secure the chin cup to straps used to secure the chinstrap to the helmet.

8B is a cross-sectional view of the chinstrap in the second position and constructed in accordance with the present disclosure.

DETAILED DESCRIPTION OF THE DISCLOSURE

Figure 1B:
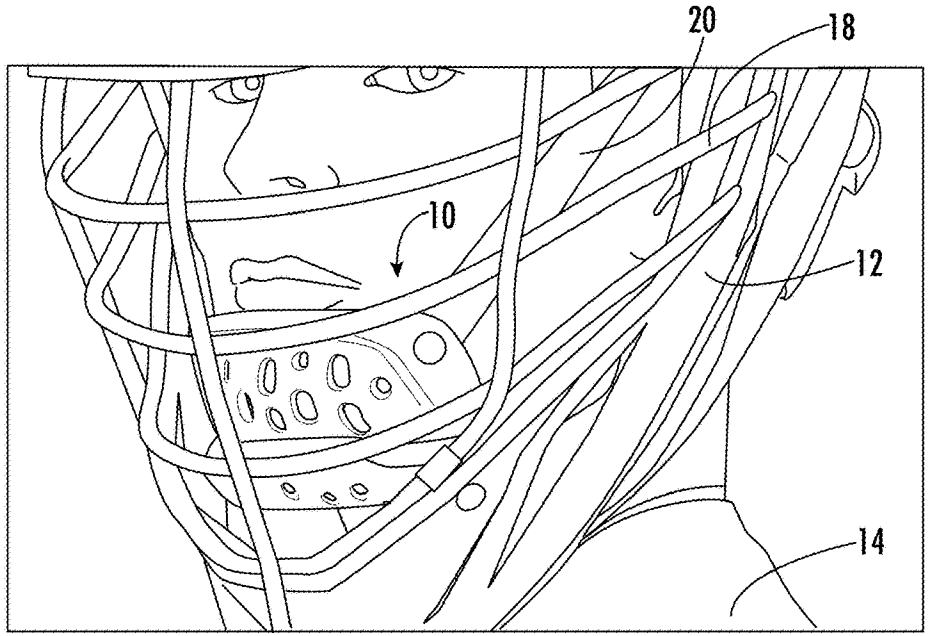
FIGS. 1A and 1B are various views of one embodiment of a chinstrap constructed in accordance with the present disclosure and shown in use with a helmet.
Figure 1A:
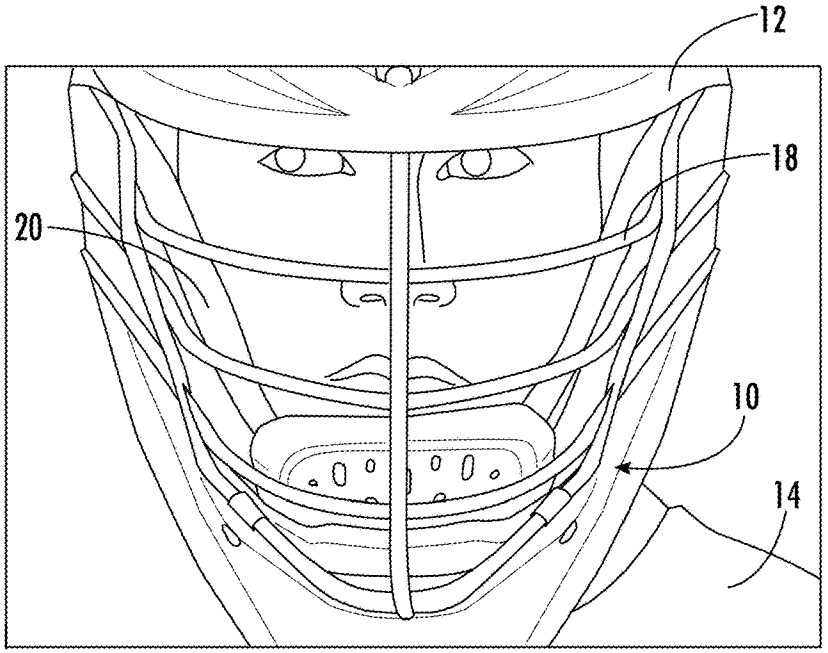
Figure 2A:
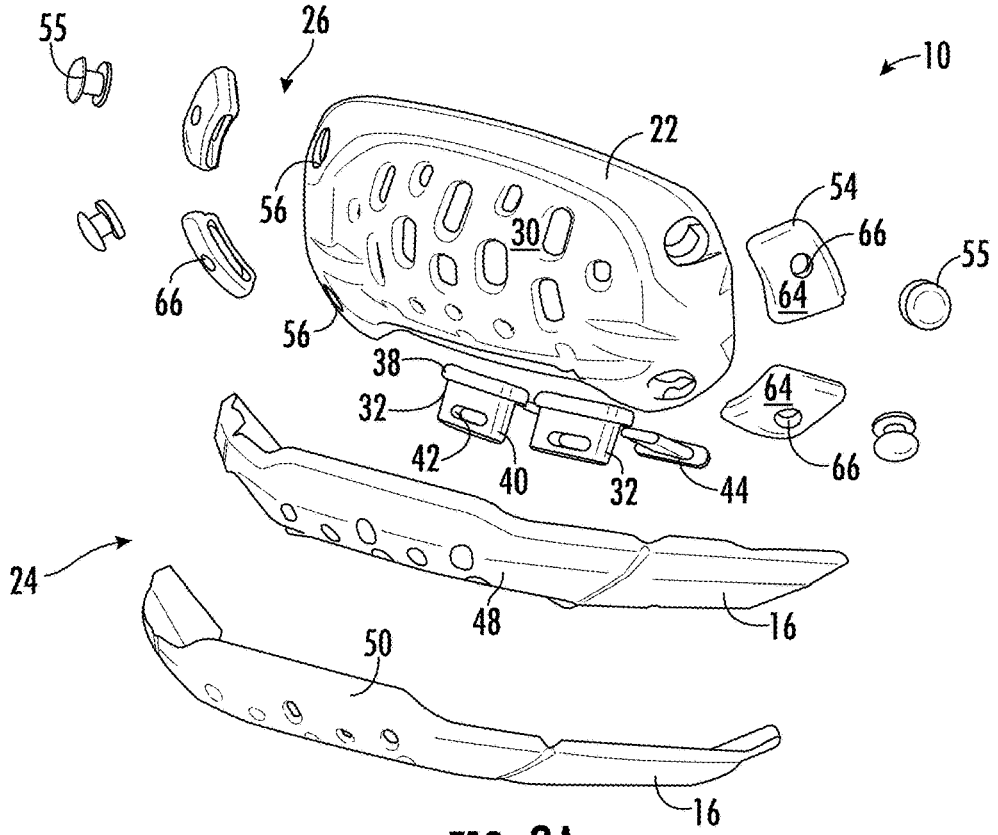
FIGS. 2A and 2B are exploded views of the chinstrap constructed in accordance with the present disclosure.
Figure 2B:
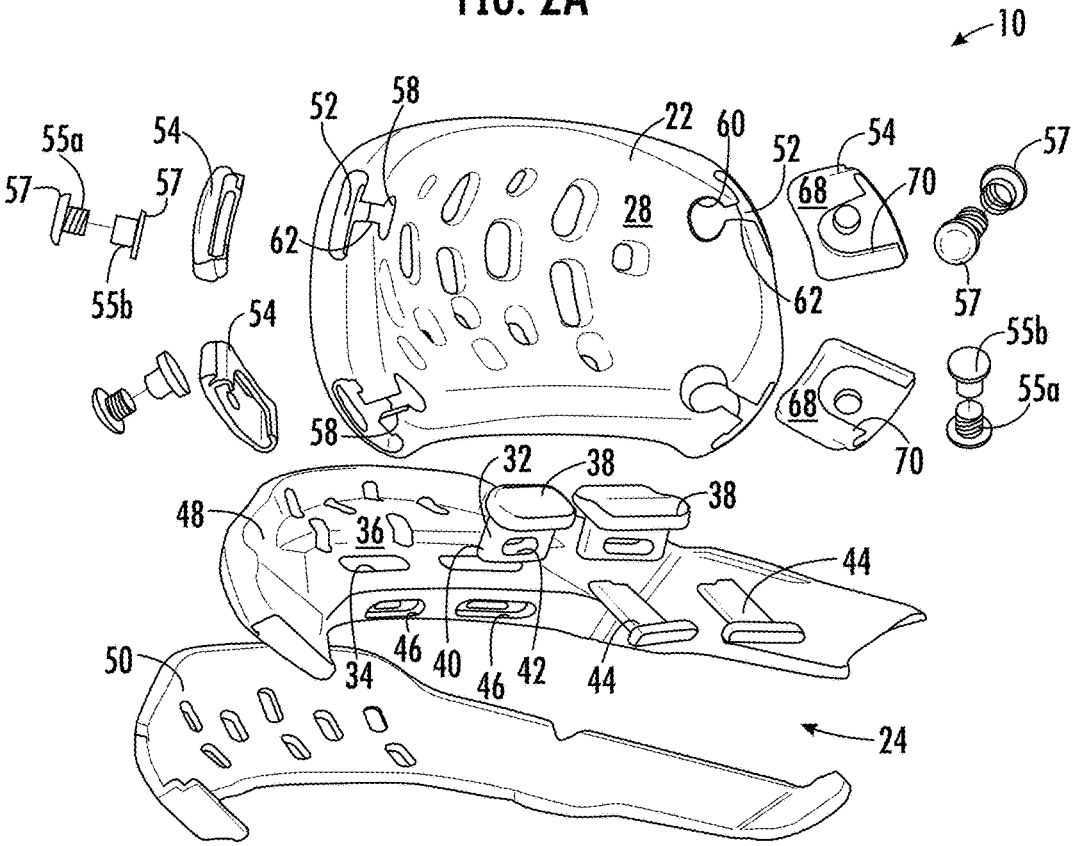
Figure 3:
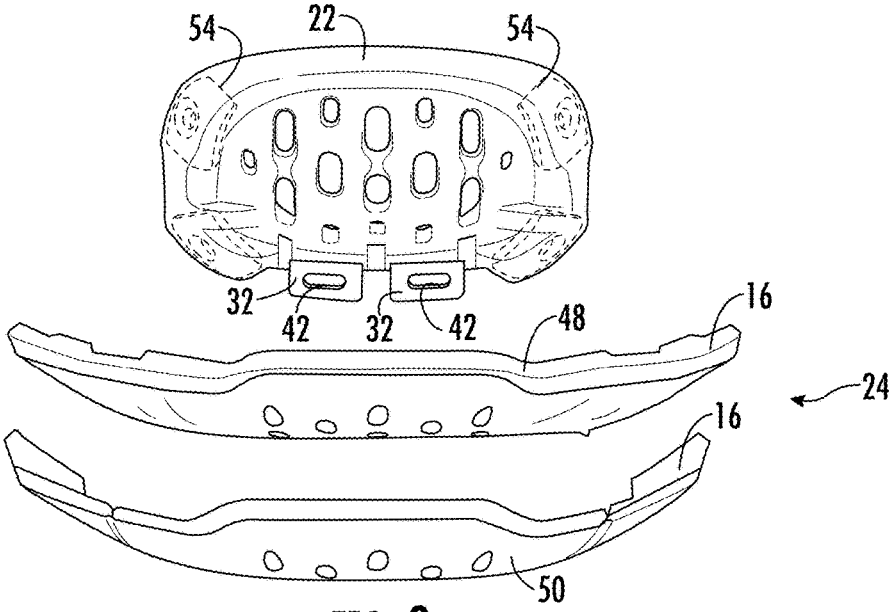
FIG. 3 is a perspective view of a portion of the chinstrap constructed in accordance with the present disclosure.
Figure 4:
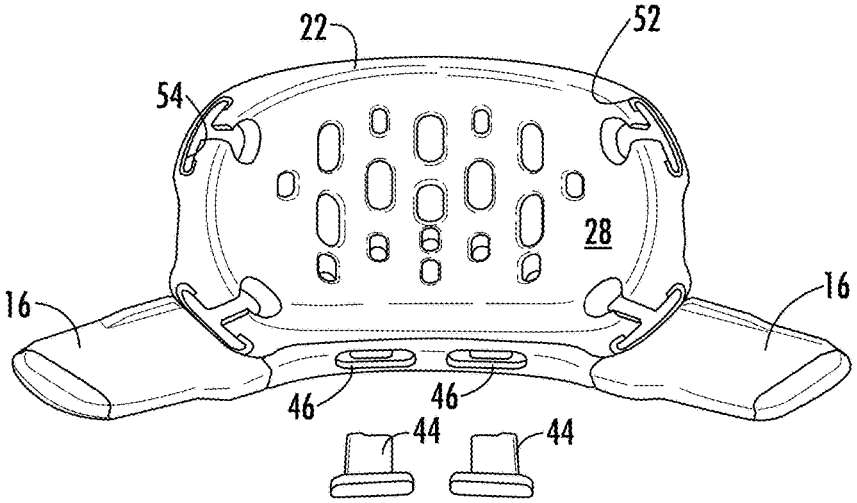
FIG. 4 is a perspective view of another portion of the chinstrap constructed in accordance with the present disclosure.
Figure 5:
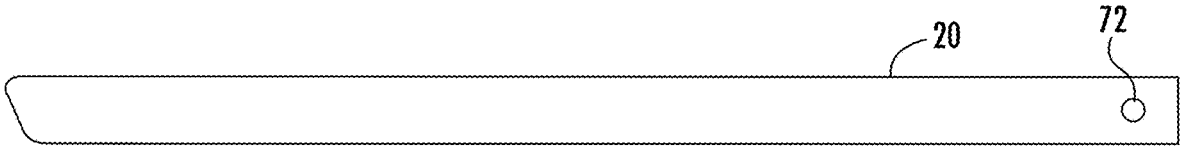
FIG. 5 is a side elevation view of yet another portion of the chinstrap constructed in accordance with the present disclosure.

Referring now to FIGS. 1A and 1B, the present disclosure is related to a chinstrap 10 for a helmet 12 used in contact sports, or any other activity where helmets are used, to protect a chin of a helmet wearer 14 and help keep the helmet 12 in a desired position on the wearer 14. The chinstrap 12 can also include jaw portions 16 to protect parts of the wearer's jaw and/or jawbone. The helmet 12 can also include a facemask 18 to protect other portion of the wearer's face. The chinstrap 10 can be secured to the helmet 12 via straps 20 that are securely attached to the chinstrap at various points and selectively securable to the helmet 12. The straps 20 can be selectively securable to the helmet 12 via any manner known in the art such as buckles, snaps, and the like.

Referring now to FIGS. 2A-5, the chinstrap 10 includes a chin cup 22 for directly receiving the chin of a helmet wearer 14, a protective structure 24, sometimes referred to herein as a protective cover, for providing an outer impact resistant component and an attachment assembly 26 for securing the chin cup 22 to the straps 20 and thus, the helmet 12. The chin cup 22 can have an inside portion 28 that receives the chin of the wearer 14 and an outer portion 30 for attachment to and support of the protective structure 24. The chinstrap 10 can also include extended supports 32 that extend from the outer portion 30 of the chinstrap 10 to engage (be inserted therein) holes 34 disposed on an inside part 36 of the protective structure 24.

The inside part 36 of the protective structure 24 is the side of the protective structure 24 that the outside portion 30 of the chinstrap 10 is disposed adjacent thereto. The extended supports 32 can have an embedded part 38 buried, or internally co-molded, in the chin cup 22 and an extended part 40 that extend from the outside 30 of the chin cup 22. The extended parts 40 of the extended supports 32 can have openings 42 therein to cooperate with other parts of the chinstrap 10 to maintain attachment of the chin cup 22 and the protective structure 24.

The chinstrap 10 can include locking pins 44 that can extend into lateral openings 46 in the protective structure 24 and through the openings 42 in the extended parts 40 of the extended supports 32 that extend from the chin cup 22 when the extended supports 32 of the chin cup 22 extend into the holes of the support structure 24. Therefore, the openings 42 in the extended supports 32 are in alignment with the lateral openings 46 of the protective structure 24 so that the locking pins 44 can be inserted through the lateral openings 46 in the protective structure 24 and into the openings 42 of the extended parts 40 of the extended supports 32. An adhesive could be used with the locking pins 44 to help secure the engagement of the locking pins 44 in place and thus, the chin cup 22 to the protective structure 24. The locking pins 44 could also have a tab (not shown) that would secure the locking pins 44 in place once they were moved so far into their engagement with the openings 42 in the extended supports 32.

The protective structure 24 can be made of an internal part 48 that can be padded and engages with the chin cup 22 and has the lateral openings 46 disposed therein and an external part 50, or vent plate, made of a harder material to better withstand impacts during use of the helmet 12 and chinstrap 10. The internal part 48 and the external part 50 can include extension members that make up the jaw portions 16 that extend down the jawline of the helmet wearer 14 to provide protection to the user's jawline.

The attachment assembly 26 is used to secure the chinstrap 10 to the straps 20. The attachment assembly 26 can include pockets 52 cut into parts of the chin cup 22 to receive sleeve members 54. The sleeve members 54 are designed to provide stability and structure to the chin cup 22 where the straps 20 are accepted and attached. The attachment assembly 26 can also include binding posts 55 that can extend through parts of the sleeve members 54, the straps 20 and the chin cup 22 to secure the straps 20 to the chin cup 22. The pockets 52 can have an aperture 56 in the outside part 30 of the chin cup 22 and a slot 58 cut in the inside 28 of the chin cup 22. In one embodiment, each slot 58 can have a bulbous part 60 and a neck part 62. The binding posts 55 can have a male end 55*a* that can be threaded into a female end 55*b*. The binding posts 55 can have flange ends 57 that are wider than the openings in the various parts of the chinstrap 10 to prevent the binding posts 55 from being disengaged with the chin cup 22.

The sleeve members 54 are made of a more rigid and stronger material than the chin cup 22 to be able to better withstand the stresses and strains placed on the chinstrap 10. The sleeve members 54 can have an outer part 64 with a hole 66 disposed therein that is generally in alignment with the aperture 56 in the outside part 30 of the chin cup 22 when the sleeve member 54 is inserted into the pocket 52. Similarly, the sleeve member 54 includes an inner side 68 with a channel 70 disposed therein generally aligned with the slot 58 disposed in the inside 28 of the chin cup 22 when the sleeve member 54 is inserted into the pocket 52. The strap 20 includes a hole 72 disposed therein that the binding post 55 extend therethrough when the strap 20 has been inserted into the pocket 52 and sleeve 54.

Each male end 55*a* of each binding post 55 can be secured to the corresponding female end 55*b* of each binding post 55 and extend through the aperture 56 and slot 58 in each pocket 52 and the hole 66 and channel 70 in each sleeve member 54. The chin cup 22 can have any number of pockets 52 such that the chinstrap 10 can properly function to keep the helmet 12 securely attached to the wearer 14 and protect the wearer's chin and other parts of the wearer's face. In one embodiment, the chin cup 22 could have four pockets 52 and each pocket could be located at the four corners of the chin cup 22.

Figure 6A:
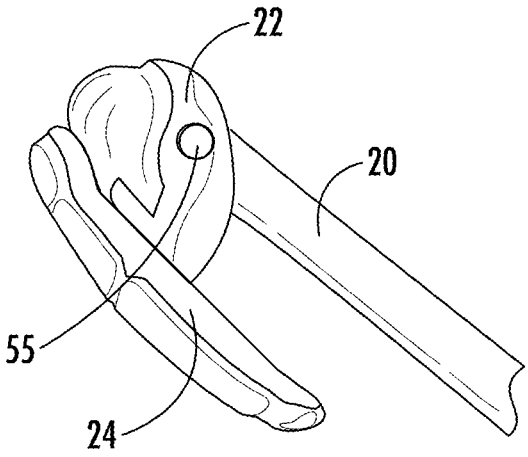
FIG. 6A is a side-elevation view of the chinstrap in a first position and constructed in accordance with the present disclosure.
Figure 6B:
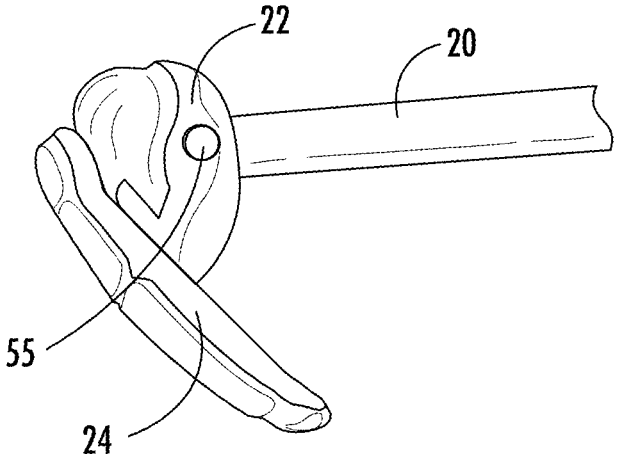
FIG. 6B is a side-elevation view of the chinstrap in a second position and constructed in accordance with the present disclosure.

Referring now to FIGS. 6A-6B, the chinstrap 10 is designed such that the straps 20 can rotate relative to the chin cup 22 a certain amount without wrenching the straps 20. This allows the straps 20 to remain flatly disposed relative to the face of the wearer. FIG. 6A shows the strap 20 rotated downward without wrenching the strap 20. Conversely, FIG. 6B shows the strap 20 rotated upward without distorting the shape of the strap 20 when the strap 20 is rotated.

Figure 7A:
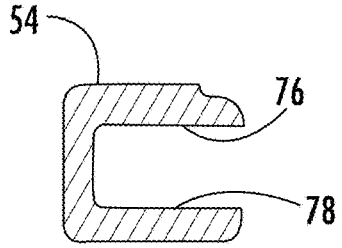
FIGS. 7*a* and 7B are cross-sectional views of a piece of the chinstrap constructed in accordance with the present disclosure.
Figure 7B:
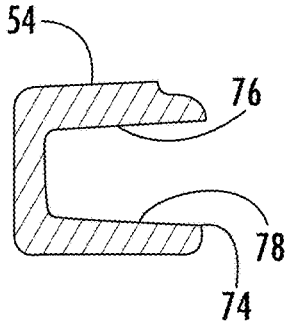
Figure 8A:
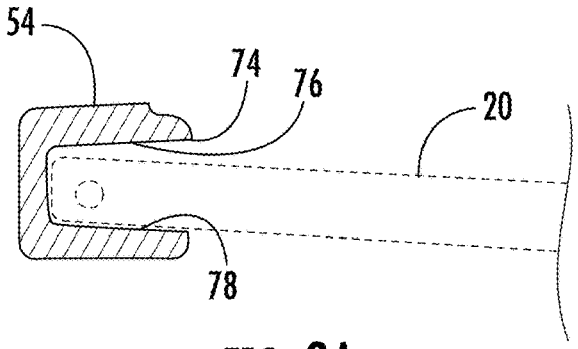
FIG. 8A is a cross-sectional view of the chinstrap in the first position and constructed in accordance with the present disclosure.
Figure 8B:
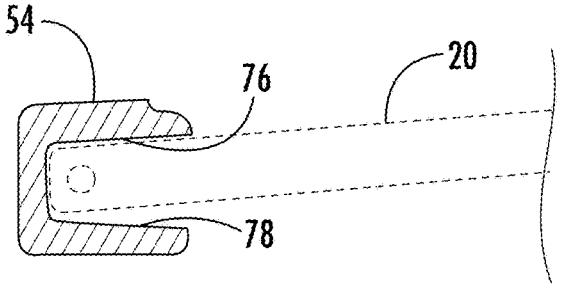

As described herein, the hole 72 in the strap 20 receives the binding post 55, which creates a rotational relationship between the strap 20 and the binding post 55 (and thus a rotational relationship relative to the chin cup 22 as well. The chinstrap 10 can be designed such that the strap 20 can rotate any desired amount relative to the sleeve 54 and the chin cup 22. In one embodiment, the strap 20 could rotate as much as 30 degrees. This permitted rotation is achieved by the unique design of sleeve 54 as shown in more detail in FIGS. 7A and 7B. The sleeve 54 includes an inlet 74 that receives the strap 20. The inlet 74 has a length and a width wherein the length is the wider part of the inlet 74. To facilitate the rotational relationship between the straps 20 and the other parts of the chinstrap 10 (e.g., the chin cup 22), the length of the inlet 74 is wider than the width of the strap 20 inserted into the sleeve 54.

The inside of the sleeve 54 can include a first shoulder 76 that provides a limit to how far the strap 20 can rotate in the sleeve 54 in a first direction and a second shoulder that provides a limit to how far the strap 20 can rotate in a second direction. In one embodiment shown in FIG. 7A, the distance between the first shoulder 76 and the second shoulder 78 is substantially the same for the length of the shoulders 76 and 78. In another embodiment shown in FIGS. 7B-8B, the distance between the first shoulder 76 and the second shoulder 78 decreases as the shoulders 76 and 78 extend from the inlet 74.

From the above description, it is clear that the present disclosure is well-adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A chinstrap for a helmet, the chinstrap comprising:
a chin cup;
a protective cover supporting the chin cup;
at least one extended support extending along a first axis from the chin cup and into the protective cover; and
at least one locking pin extending along a second axis into the protective cover and into engagement with the at least one extended support to secure the chin cup to the protective cover,
wherein the second axis is transverse to the first axis.

2. The chinstrap of claim 1, wherein the protective cover includes an internal part, formed of a first material, and an external part, formed of a second material, the second material being made of a harder material than the first material to withstand impact.

3. The chinstrap of claim 1, further comprising jaw portions that extend from the protective cover in a direction such that the jaw portions are configured to be in general alignment with a helmet wearer's jawline when worn.

4. The chinstrap of claim 1, wherein the at least one extended support protrudes from an outside part of the chin cup.

5. The chinstrap of claim 4, wherein the protective cover has holes disposed therein for receiving the at least one extended support.

6. The chinstrap of claim 1, wherein the at least one extended support includes an embedded part that is disposed in the chin cup and an extended part that protrudes from the chin cup.

7. The chinstrap of claim 6, wherein the extended part of the at least one extended support has a support opening.

8. The chinstrap of claim 7, wherein the at least one locking pin is configured to extend into and through lateral openings in the protective cover and into the support opening in the extended part of the at least one extended support.

9. The chinstrap of claim 8, wherein the lateral openings of the protective cover are disposed in an internal part of the protective cover.

10. The chinstrap of claim 1, wherein the chin cup has pockets and each pocket is configured to receive a strap for securing the chinstrap to the helmet.

11. The chinstrap of claim 10, wherein a sleeve is disposed in each one of the pockets to provide structural reinforcement configured to withstand forces applied to the chin cup.

12. The chinstrap of claim 11, wherein each one of the pockets has an aperture in an outside part of the chin cup and a slot cut into an inside part of the chin cup.

13. The chinstrap of claim 12, wherein the slot has a bulbous portion and a neck portion.

14. The chinstrap of claim 13, wherein each sleeve includes a hole disposed therein in an outer part of the sleeve in general alignment with the aperture in the outside part of a respective one of the pockets and a channel disposed in an inner side of the sleeve in general alignment with the slot in the inside part of the respective one of the pockets.

15. The chinstrap of claim 14, further including binding posts, wherein a portion of the binding posts extend through the aperture of a respective one of the pockets of the chin cup, a hole in the strap, and the hole in the sleeve disposed in the respective one of the pockets.

16. The chinstrap of claim 11, wherein the sleeve has an inlet for receiving the strap and the inlet is wider than a width of the strap to permit rotation of the strap, the sleeve having a first shoulder and a second shoulder therein to define limits the strap can rotate without distortion.

17. The chinstrap of claim 16, wherein a distance between the first shoulder and the second shoulder in the sleeve decreases as the first shoulder and second shoulder extend from the inlet.

18. The chinstrap of claim 10, wherein the pockets are positioned in at least two locations on the chin cup.

19. The chinstrap of claim 10, wherein the pockets are positioned at four corners of the chin cup.

20. The chinstrap of claim 1, further comprising one or more straps that are rotatable relative to the chin cup without distortion of the one or more straps.

* * * * *